US005538406A

United States Patent [19]

Siegal et al.

[11] Patent Number: 5,538,406

[45] Date of Patent: Jul. 23, 1996

[54] REMOVABLE CARTRIDGE-TYPE PUMP FOR LIVE WELL BAIT TANKS IN SPORT FISHING BOATS

[75] Inventors: Burton L. Siegal, Skokie; Irvin W. Hines, Crystal Lake, both of Ill.

[73] Assignee: Johnson Pumps of America, Inc., Schiller Park, Ill.

[21] Appl. No.: 204,514

[22] Filed: Mar. 2, 1994

[51] Int. Cl.[6] ..... F04B 35/00

[52] U.S. Cl. ..... 417/360; 417/361

[58] Field of Search ..... 417/360, 361

[56] References Cited

U.S. PATENT DOCUMENTS

| | | | |
|---|---|---|---|
| 3,000,543 | 9/1961 | Paul | 417/360 X |
| 3,982,856 | 9/1976 | Hehl | 417/360 |
| 4,734,016 | 3/1988 | Sailer | 417/360 |
| 4,880,364 | 11/1989 | Berfield | 417/360 X |
| 4,904,166 | 2/1990 | Wasemann | 417/360 |
| 5,044,883 | 9/1991 | Neuder | 417/360 X |

*Primary Examiner*—Richard E. Gluck
*Attorney, Agent, or Firm*—Hill, Steadman & Simpson

[57] ABSTRACT

A removable cartridge-type pump for live well bait tanks in sport fishing boats wherein a motor impeller unit can be rapidly inserted and removed from a housing to which an input pipe is connected so as to clean the impeller and pump cavity and/or replace it with the different unit. An O-ring seal between the housing and the impeller unit serves as a liquid seal and also as a spring bias between the units. Either a bayonet connection or a screw connection may be made between the units and locking sears are provided so as to positively lock the units together.

9 Claims, 3 Drawing Sheets

REMOVABLE CARTRIDGE-TYPE PUMP FOR LIVE WELL BAIT TANKS IN SPORT FISHING BOATS

BACKGROUND OF THE INVENTION

1. Field of the Invention

This invention relates in general to pumps and in particular to a removable cartridge-type pump for live well bait tanks used, for example, in sport fishing boats.

2. Description of Related Art

Sport fishing boats are commonly equipped with one or more holding tanks which are often referred to as live well tanks for live bait and which can be also used to keep fish which have been caught alive. Such tanks are customarily fitted with a pump so as to supply aerated fresh or salt water so as to continuously replace the water in the tank. The pump's intake is below the water line and its discharge is into the tank. The water level in the tank is controlled generally by a drain tube which discharges overboard. The aerated water is important so as to keep the bait fresh and active and is absolutely vital for tournament fishing contests wherein the catch is kept alive and reasonably healthy after which it is weighed and then released back into the body of water from which it was taken.

Pumps presently manufactured and marketed for this purpose have several shortcomings in that the impellers of the pumps frequently become clogged with debris causing them to lose capacity or seize up completely. When this happens, the pump must be unfastened from the hull and its plumbing connections, then disassembled and cleaned by the fisherman. Most generally this means removing the boat from the water or he also must make a plug of sorts to keep his boat from being flooded from the open intake port. A continuous lock motor condition can often cause a motor failure if the fusing or circuit breaker protection does not detect it and cutoff power. If the pump should fail for any mechanical or electrical reason, it must be replaced with a spare which is a time-consuming operation. Also, if the fishman should switch types of bait or go from bait to catch in the tank, he may require a larger capacity pump. Such second pump can either be installed in a parallel standby capacity or it may be used as a replacement for a smaller pump which first must be removed and the larger pump installed. Such procedures are highly undesirable for the normal fishmen and are intolerable to competition fishmen to whom every second is important.

SUMMARY OF THE INVENTION

The present invention comprises a removable cartridge-type pump for live well bait tanks in sports fishing boats wherein the motor, its electrical input and the impeller of the pump are made into a single cartridge-like unit that may be quickly engaged and disengaged from the body chamber, mounting flange and inlet and outlet ports of the pump which constitute a second housing member. The housing receives, seals and fastens in place the cartridge unit without the use of any tools. Wing-like projections are attached to the end of the cartridge unit and allow a user to easily twist the cartridge member to release it. The cartridge member can be quickly released and withdrawn from the housing creating access to the interior of the pump so that the impeller and its chamber can be immediately cleared of debris. In a preferred embodiment, a bayonet-type engagement between the cartridge and the housing is used. Alternatively, a threaded engagement of the cartridge with the housing can be utilized.

The present invention allows instantaneous replacement of a failed or a clogged motor/impeller cartridge and allows for an equally quick substitution of a larger or lesser capacity pump motor as desired and does so without the need of the use of tools and without having to disturb any of the plumbing connections of the system.

It is an object of our invention to provide an improved O-ring seal which is used both as a hydraulic seal and as an axial compression spring. Normally O-rings are mounted in grooves either in a male or female member which is being sealed. In the present invention, the O-ring is mounted between the cartridge and the housing unit in a groove formed between them and the width of the groove is a static distance created by the physical dimensions of the parts when normally engaged. This would occur when the projections of the bayonet tabs are locked in the recesses which maintain the locked position. Bayonet connections conventionally require spring-like elements to keep the assembly locked in place in the detented position. In the present invention, when the projection attempts to arise out of the detent recess, the gap that defines the O-ring groove is reduced in size thus compressing the O-ring and causing it to elastically flow as it resists with a spring-like action. Although in the invention only a single O-ring is used, the invention also could be applied to a two-ring structure wherein one is used for sealing and one is used as a spring. In an alternative embodiment, a threaded connection is made between the cartridge and the housing and the O-ring will axially compress and flow as the cartridge is threaded to its stop shoulder. A definite stopping point is highly desirable so as to maintain a tightly controlled gap between the face of the impeller and the inside bottom of the chamber in which it operates. The equivalent of the stop shoulder in the bayonet configuration is the bottom of the detent recess. The spring function of the O-ring in the threaded alternative is to take up the actual clearance of the threads and provide a highly frictional resistance to unthreading due to vibration and so forth. This would take place on the multiple surfaces in contact on the threads as well as the surface of the cartridge bearing directly upon the O-ring.

Pumps of the type of this invention generally are placed low in the boat and as much cut of the way as possible. This means that a user might have restricted access and visibility when servicing the pump. Rather than using the conventional "L" configuration for the bayonet receive slot, the present invention uses an angled corner for the slot so that when the cartridge is pressed down into its housing the corner will cause the cartridge to begin to turn in the locking direction as it reaches the bottom of its travel. The tabs on the bayonet have a mating chamfer which engage the ramp so as to allow the user to easily rotate the cartridge into its locked position.

Since the water intake for the pump is below the water line, it is vital that the cartridge not inadvertently become loose from its mating housing. For this reason, a safety interlock between the cartridge and the housing is provided. Sport fishing boats are subject to very intense vibrations and impact shocks and a positive lock prevents separation between the cartridge and the housing. The invention provides a positive lock that prevents counterclockwise rotation of the cartridge relative to its stationary housing in the locked position. The housing is provided with a mounting boss that also contains a slot that will cooperate with the mating blade on a blocking lever which is commonly referred to as a sear. The sear is resiliently urged into engagement with the slot. In an alternative arrangement, the sear contains a projection that fits between the bayonet and the portion of the mating slot adjacent to it so that the cartridge cannot be rotated unless the sear is moved perpendicular to the direction of the force of rotation.

One embodiment of the interlock has a slot mating blade with opposite edges which are chamfered so that it can be rotated counterclockwise and can immediately snap back into the original position upon release of the rotating force. Since its other opposed blade edges are not chamfered, the sear is constrained against rotating by the walls of the slot on the housing side. The sear has a projecting arm that blocks rotation of the wing of the cartridge when the sear is in its normal position. When assembling the cartridge into the housing, the wing will strike the sear's projecting arm on its opposite side causing the sear to rotate out of its blocking position allowing the cartridge to continue rotating to its detented position. As the wing passes the deflected arm, due to the chamfer on its blade and the spring-like response from the resilient mounting, the sear will snap back to its normal blocking position. The sear also contains another arm which is generally at right angles to the blocking arm that when pressed can be used to deflect the sear out of its blocking position when the user desires to remove the cartridge from the housing. This type of sear can also work with the alternative embodiment of a threaded engagement of the cartridge.

The present invention also has increased pumping efficiency which is accomplished with two internal features. First, projections axially deflect the rotating mass being pumped upward toward the discharge port. The projections protrude from the conical cavity generally just above the principal centrifugal thrust of the impeller and, thus, do not restrict the impeller accelerating the mass of water to its maximum possible velocity before it strikes the upper rising taper of the chamber and the projections help convert the angular velocity vector of the water into axial velocity.

Second, the wall of the cartridge just tangential to the upper surface of the discharge port is bulged out so as to cause the rotating mass of water to exit through the discharge port with a minimum of turbulence and, thus, maintain its velocity. It is the force of the water which is a function of the square of its velocity that contributes to the high delivery pressures which are obtained with this invention.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
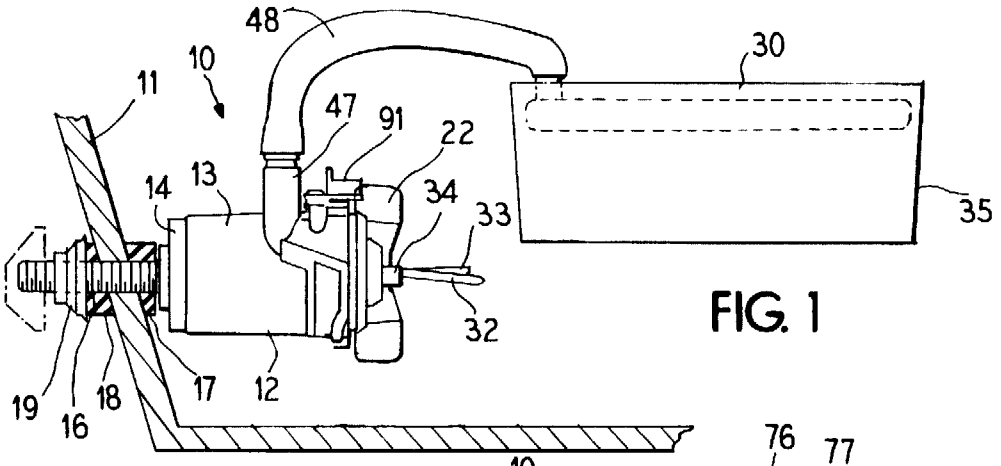
FIG. 1 is a side plan view of the invention.

FIGS. 1–12 illustrate a first embodiment of the invention 10 which comprises a housing portion 12 and a bayonet mounted motor portion 15. A substantial portion of the housing 12 and the motor portion 15 may be made out of plastic, for example. The housing portion 12 is formed with a cylindrical body portion 13 to which is attached an end 14 by suitable screws such as 23 and 24 illustrated in FIG. 2, for example. The end 14 is integrally formed with an externally threaded inlet pipe 16 for mounting the pump to the side wall or transom 11 of a boat as illustrated in FIG. 1. Sealing washers 17 and 18 are formed with a central opening through which the threaded pipe 16 extends and a threaded nut 19 is received on the threaded portion so as to attach the pump 10 to the boat. The inlet 21 of the pipe 16 is mounted so that it is below the water level to allow intake of water into the pump. An outlet tube 47 connects to a flexible pipe 48 which is connected to an aerating head 30 mounted in the live well 35. An outlet pipe, not shown, provides for overflow from the live well 35 back into the water. The motor portion 15 comprises a pump impeller 28 mounted adjacent the discharge end of the input pipe 16 and the impeller 28 is mounted on the output shaft 29 of a motor 31 that is connected by suitable pins 61 and 62 to the end of a tapered truncated conical portion 36 of the bayonet housing 15. The tapered portion 36 connects to a cylindrical housing portion 37 of the motor portion 15 and has a shoulder 38 which extends outwardly toward the cylindrical walls 13 of the housing 12. At the end of shoulder 38, a cylindrical portion 39 is concentric to the portion 37 and is formed with a shoulder outwardly extending portion 41 which joins with a third concentric cylindrical extending portion 44 that connects to the cover 46 of the bayonet motor impeller portion 15. Large wings 22 are connected to the cover 46 to allow the bayonet mounted motor portion 15 to be easily rotated by the user's hand. The end 62 of the cover member 46 is provided with a hollow extension 34 through which the motor leads 32 and 33 extend.

Figure 3:
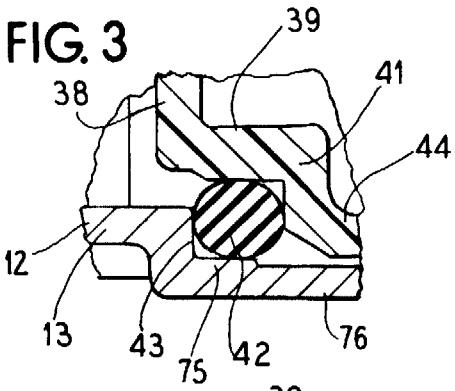
FIG. 3 is an enlarged sectional view showing the O-ring before it is compressed.

The housing's cylindrical wall 13 has an outwardly extending portion 43 that adjoins its right end relative to FIG. 3 and which connects to a short, horizontally extending concentric cylindrical portion 75. This cylindrical portion 75, continues at a slightly larger cylindrical portion 76. A flange 77 is formed about the end of the cylindrical portion 76. The portion 15 is detachably connected to the housing 12 by means which will be subsequently described including tabs 82 which are mounted in slots 81 shown in greater detail in FIG. 8. It is to be realized that there is a slot 81 on each side of the housing portion 76 and that the cylindrical portion 44 is formed with a pair of tabs 82 which pass downwardly into the slots 81 and engage tapered portions 80 which rotate the motor portion 15 relative to slots 81 so that the tabs 82 which have a projecting portion 87 passes along the bottom 83 of the slot 81 until the extension 87 is received in a detent recess 86 formed in a member 84, which is an extension of flange 77 of the housing 12.

Figure 2:
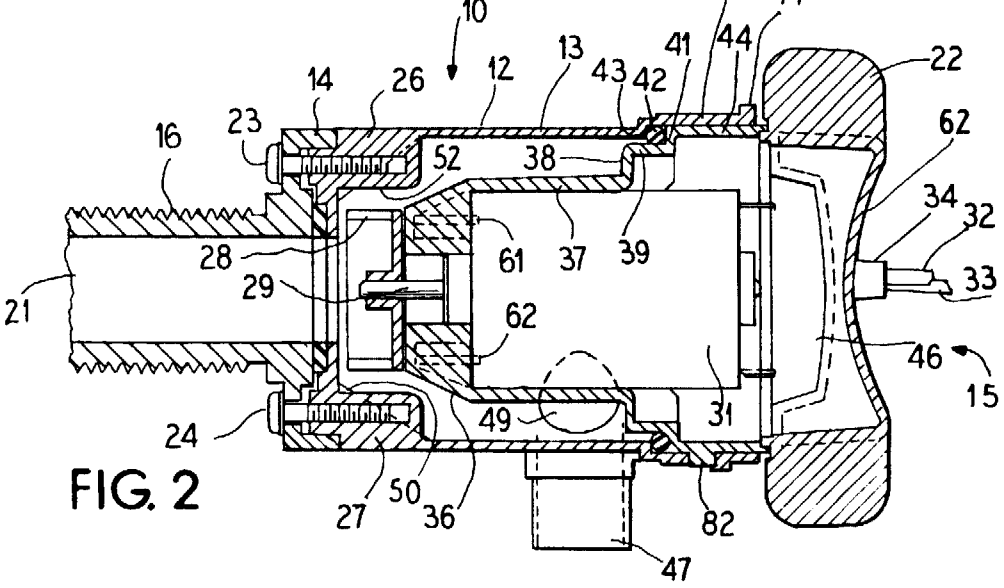
FIG. 2 is a sectional view of the invention.
Figure 4:
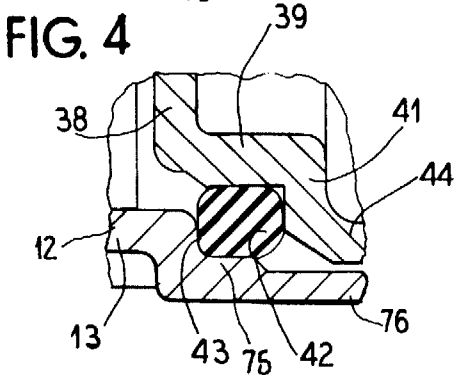
FIG. 4 illustrates the O-ring as it starts to compress.
Figure 5:
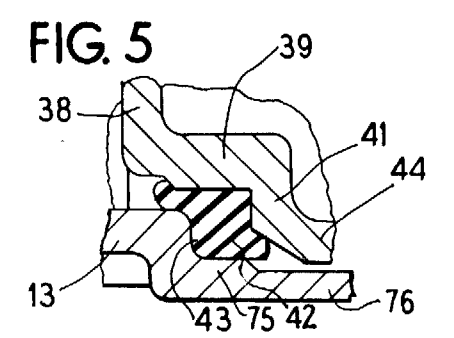
FIG. 5 illustrates the O-ring in the maximum compressed position.
Figures 6, 7, 8, 9, 10, 11:
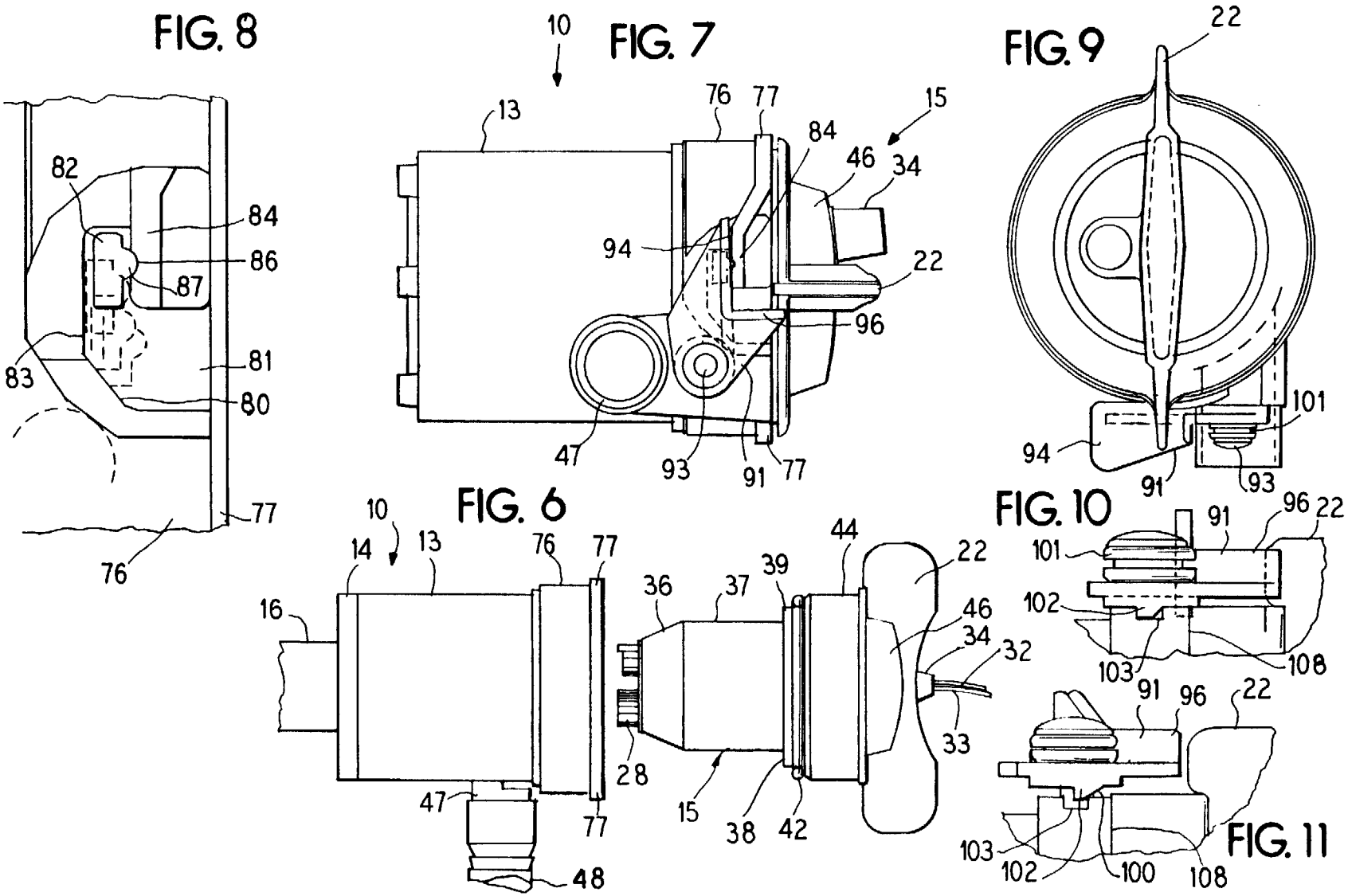
FIG. 6 is an exploded view illustrating the bayonet pump and housing.
FIG. 7 illustrates the bayonet pump and housing in the assembled position.
FIG. 8 illustrates the tapered slot used for locking the bayonet to the housing.
FIG. 9 is an end view of the invention.
FIG. 10 illustrates the locking sear in the locked position.
FIG. 11 illustrates the locking sear moving to the unlocked position.

The tabs 82 are biased to the right relative to FIGS. 2, 3 and 8 by a flexible O-ring 42 which is mounted between the extending walls 41 of the motor portion 15 and the extending portion 43 of the housing 12. As shown in FIGS. 3, 4 and 5 when the motor portion 15 initially engages the housing 12, the O-ring 42 is undistorted as shown in FIG. 3 and as the motor portion 15 is pushed to the left relative to FIG. 2, the O-ring 42 is distorted by the pressure between the walls 41 and 43 so that it takes the shape shown in FIG. 4. As the motor portion 15 is further inserted into the housing 12 and rotated, the O-ring 42 is distorted to the shape shown in FIG. 5. When the projecting portion 87 reaches and seats into the recess 86, this maximum distortion of O-ring 42 illustrated in FIG. 5 relaxes slightly so that it serves two purposes. It provides a water seal between portions 43 and 75 of the housing 12 and portions 39 and 41 of the motor portion 15 to prevent water from passing into the boat through the connection between these two members and furthermore it provides a spring bias so as to lock the tabs 82 with their extending portions 87 in the detent recesses 86 of the housing 12.

Figure 12:
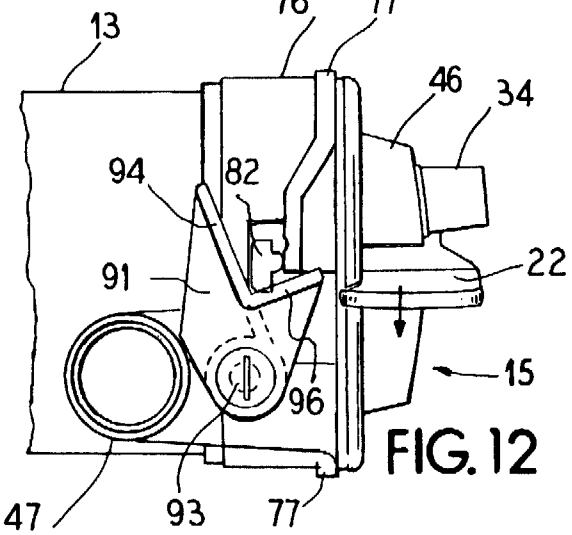
FIG. 12 is a side view showing the locking sear in the unlocked position.

Due to vibration of the boat, it is desired to provide a secondary lock between the motor portion 15 and the housing 12 which in the first embodiment comprises an L-shaped sear 91 illustrated in FIGS. 1,7,9,10, 11 and 12. The sear 91 is formed with a pair of extending legs 96 and 94 which extend at right angles to each other as illustrated in FIG. 12 and the sear is rotatably mounted on a screw 93 that is connected to the housing and which extends through a sleeve portion of the sear 91. The extending portion 96 when in the locked position illustrated in FIGS. 7 and 10 is engageable with the wing portion 22 of the cover 46 so as to prevent more than minimal rotation of the motor portion 15 relative to the housing 12. A resilient compressive sleeve 101 is mounted between the screw 93 and the sear has an extending portion 102 which is receivable in a notch 103 in a boss 108 projecting from portion 76 of the housing 12 as shown in FIGS. 10 and 11.

When it is desired to remove the motor portion 15 from the housing 12, the leg 94 of the sear 91 is pushed downwardly to the position shown in FIG. 12 so that the extending leg 96 clears the tab 22 and then the motor portion 15 can be rotated by moving the wing 22 downwardly relative to FIG. 12 so that the extension 87 moves out of the detent recess 86 so that the tabs 82 can move downwardly in the portion 83 of the slot 81 as shown in FIG. 8 and the motor portion 15 can then be separated from the housing 12 to allow the impeller 28 and/or the inside of housing 12 to be cleaned and/or a new bayonet motor unit to be inserted into the housing 12. It is to be realized, of course, that a stopper should be replaced over the end of the threaded inlet pipe 16 when the bayonet unit is removed from the housing 12 so as to prevent water from entering the boat to the inlet pipe 16.

The extending portion 102 is biased by the compressive sleeve 101 into the slot 103, but due to a taper 100 on portion 102 when the motor portion 15 is replaced into the housing 10, the wing 22 will rotate the sear 91 and cause portion 102 to climb out of notch 103 allowing further rotation of sear 91 so as to let the wing pass the portion 96 after which the sear moves back in to the locked position. The portion 94 of sear 91 is manually moved in the counterclockwise direction relative to FIG. 7 so as to allow the wing portion 22 to pass over the extending leg 96 when it is desired to remove the bayonet unit 15. The action of the taper 100 facilitates rotation in the counterclockwise direction.

Figure 13:
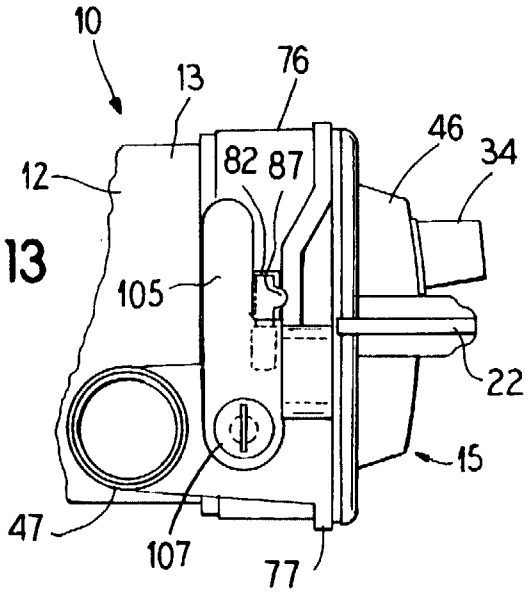
FIG. 13 illustrates a modified form of the locking sear.
Figure 14:
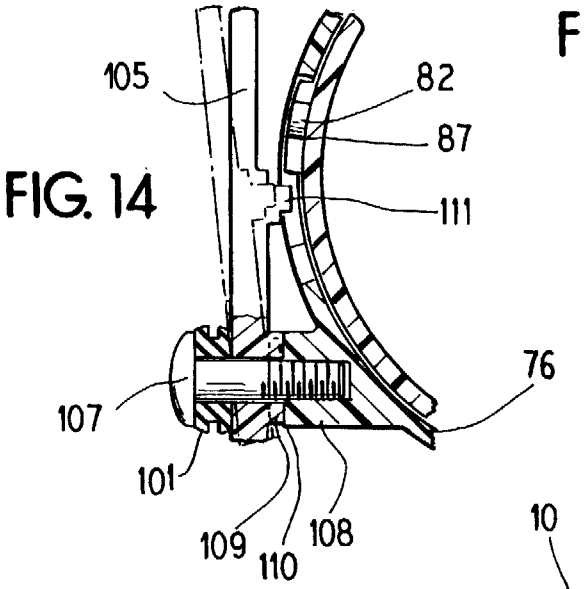
FIG. 14 is another view of the locking sear of FIG. 13.

FIGS. 13 and 14 illustrate a modified locking sear of the invention which replaces the sear 91 of the first embodiment. In the embodiment of FIGS. 13 and 14, a locking sear 105 is attached by a screw 107 to a boss 108 on the housing portion 76. The sear 105 has a square sided extension 109 engaging a square sided slot 110 in boss 108 to maintain angular alignment of sear 105. A resilient compressive sleeve 101 is mounted between the screw 107 and the sear 105. A tab 111 on sear 105 is receivable in slot 81 so that it engages the end of tab 82 as shown in FIGS. 13 and 14 so as to prevent its rotation and lock the motor portion 15 to the housing 12. When it is desired to remove the motor portion 15 from the housing 12, the sear 105 is moved to the dash-dot position shown in FIG. 14 so that the extension 111 does not engage the tab 82 so that the motor portion 15 can be rotated and removed from the housing 12.

Figure 15:
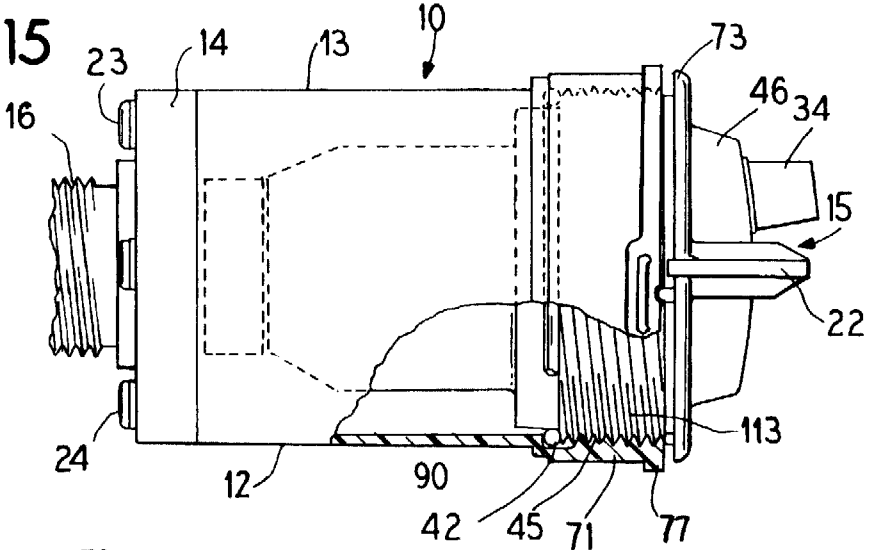
FIG. 15 illustrates a threaded embodiment of the invention.

A further modification of the invention is illustrated in FIG. 15 wherein instead of a bayonet connection between the housing 12 and the motor portion 15, the upper end of the motor portion 15 is formed with external threads 113 which mate with internal threads 45 on the portion 71 of the housing 12 so as to connect the motor portion 15 to the housing 10. The O-ring 42 provides a seal and lock between a square undercut 90 at the beginning of threads 113 and the extending portion 43 of housing 12. As the threaded engagement compresses it, providing a liquid seal and also a spring bias to lock the motor portion 15 relative to the housing 10. A locking sear such as shown in FIG. 12 may also be used in the embodiment of FIG. 15 if it is desired.

As best illustrated in FIG. 2, there is a conical section 50 of the housing 12. It is interrupted by axial projections 52 whose degree of intrusion increase as the conical diameter increases. The maximum intrusion is reached beyond the radial projection of the discharge of impeller 28. These projections 52 have body portions 26 and 27 that respectively receive screws 23 and 24. The swirling water driven by impeller 28 is increasingly urged axially through the tubular cavity between cylindrical members 13 and 37 until they reach, still swirling, the shoulder 38 of the motor portion 15. The shoulder 38 is positioned tangential to the side furthest from the impeller of the exit hole 49 for outlet tube 47. The exit hole 49 is also tangent to the inside of cylindrical portion 13 on a side compatible with the direction of rotation of the impeller 28.

It is seen that this invention provides a new and novel removable cartridge-type pump and although the invention has been described with respect to preferred embodiments, it is not to be so limited as changes and modifications can be made which are within the full intended scope of the invention as defined by the appended claims.

I claim as our invention:

1. A removable cartridge type pump for use in boats comprising:

a hollow cylindrical body portion, a motor portion receivable within and detachably connected to said hollow cylindrical body portion, and including a motor with an output shaft, a pump impeller mounted on the output shaft of said motor, an inlet pipe connected to said hollow cylindrical body portion, an outlet pipe connected to said hollow cylindrical body portion, an annular flexible gasket receivable between said hollow cylindrical body portion and said motor portion when they are in the assembled relationship to provide a fluid seal therebetween, and principle locking means for locking said motor portion to said hollow cylindrical body portion, including a secondary locking means for locking said motor portion to said hollow cylindrical body portion, and wherein said secondary locking means comprises a sear which is movably mounted on said hollow cylindrical body portion and which can be moved from a first locking position where it engages said motor portion to a second position where it does not prevent movement between said motor portion and said hollow cylindrical body portion.

2. A removable cartridge type pump for use in boats according to claim 1 wherein said principle locking means comprises a bayonet connection between said hollow cylindrical body portion and said motor portion.

3. A removable cartridge type pump for use in boats according to claim 2 wherein said bayonet connection comprises at least one L-shaped slot formed in said hollow cylindrical body portion and at least one tab formed on said motor portion which is receivable in said L-shaped slot.

4. A removable cartridge type pump for use in boats according to claim 3 wherein said L-shaped slot is formed with a tapered portion.

5. A removable cartridge type pump for use in boats according to claim 3 wherein L-shaped slot has a detent opening and said tab has an extension receivable in said detent opening.

6. A removable cartridge type pump for use in boats according to claim 1 including an extension formed on said motor portion which is engageable with said sear in said locking position.

7. A removable cartridge type pump for use in boats according to claim 1 wherein said sear is L-shaped with extending legs and is rotatably mounted on said hollow cylindrical body portion.

8. A removable cartridge type pump for use in boats according to claim 1 wherein said sear is attached to said hollow cylindrical body portion and can be moved outwardly therefrom to disengage it from said motor portion.

9. A removable cartridge type pump for use in boats comprising: a hollow cylindrical body portion, a motor portion receivable within and detachably connected to said hollow cylindrical body portion, and including a motor with an output shaft, a pump impeller mounted on the output shaft of said motor, an inlet pipe connected to said hollow cylindrical body portion, an outlet pipe connected to said hollow cylindrical body portion, an annular flexible gasket receivable between said hollow cylindrical body portion and said motor portion when they are in the assembled relationship to provide a fluid seal therebetween, and principle locking means for locking said motor portion to said hollow cylindrical body portion, and including axially extending members mounted within a conical end of said hollow cylindrical body portion adjacent said outlet pipe and the distance of intrusion of said axially extending members increasing as the diameter of said conical end increases.

* * * * *